US010433384B2

(12) United States Patent
Huang et al.

(10) Patent No.: US 10,433,384 B2
(45) Date of Patent: Oct. 1, 2019

(54) LED DRIVER WITH SILICON CONTROLLED DIMMER, APPARATUS AND CONTROL METHOD THEREOF

(71) Applicant: Silergy Semiconductor Technology (Hangzhou) LTD, Hangzhou, ZheJiang Province (CN)

(72) Inventors: Qiukai Huang, Hangzhou (CN); Jianxin Wang, Hangzhou (CN); Huiqiang Chen, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 15/955,853

(22) Filed: Apr. 18, 2018

(65) Prior Publication Data

US 2018/0310376 A1 Oct. 25, 2018

(30) Foreign Application Priority Data

Apr. 21, 2017 (CN) ..... 2017 1 0263893

(51) Int. Cl.
*H05B 33/08* (2006.01)

(52) U.S. Cl.
CPC ..... *H05B 33/0845* (2013.01); *H05B 33/0809* (2013.01); *H05B 33/0824* (2013.01)

(58) Field of Classification Search
None
See application file for complete search history.

(56) References Cited

U.S. PATENT DOCUMENTS

| | | | | |
|---|---|---|---|---|
| 8,614,551 | B2 | 12/2013 | Chen et al. | |
| 9,125,270 | B2 | 9/2015 | Liao et al. | |
| 9,578,706 | B1 | 2/2017 | Lai et al. | |
| 2013/0241427 | A1* | 9/2013 | Kesterson | H05B 37/02 315/210 |
| 2014/0062322 | A1 | 3/2014 | Yu et al. | |

* cited by examiner

*Primary Examiner* — Jany Richardson
(74) *Attorney, Agent, or Firm* — Michael C. Stephens, Jr.

(57) ABSTRACT

An apparatus can include: a bleeder circuit coupled to a DC bus of an LED driver having a silicon-controlled dimmer; the bleeder circuit being configured to control a voltage of the DC bus to vary in a predetermined manner by drawing a bleed current through a bleed path when in a first mode, and to cut off the bleed path when in a second mode; and a controller configured to control the bleeder circuit to be in the first mode before the silicon-controlled dimmer is turned on.

19 Claims, 14 Drawing Sheets

LED DRIVER WITH SILICON CONTROLLED DIMMER, APPARATUS AND CONTROL METHOD THEREOF

RELATED APPLICATIONS

This application claims the benefit of Chinese Patent Application No. 201710263893.2, filed on Apr. 21, 2017, which is incorporated herein by reference in its entirety.

FIELD OF THE INVENTION

The present invention generally relates to the field of power electronics, and more particularly to an LED driver with a silicon-controlled dimmer, along with associated circuits and methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Figure 1:
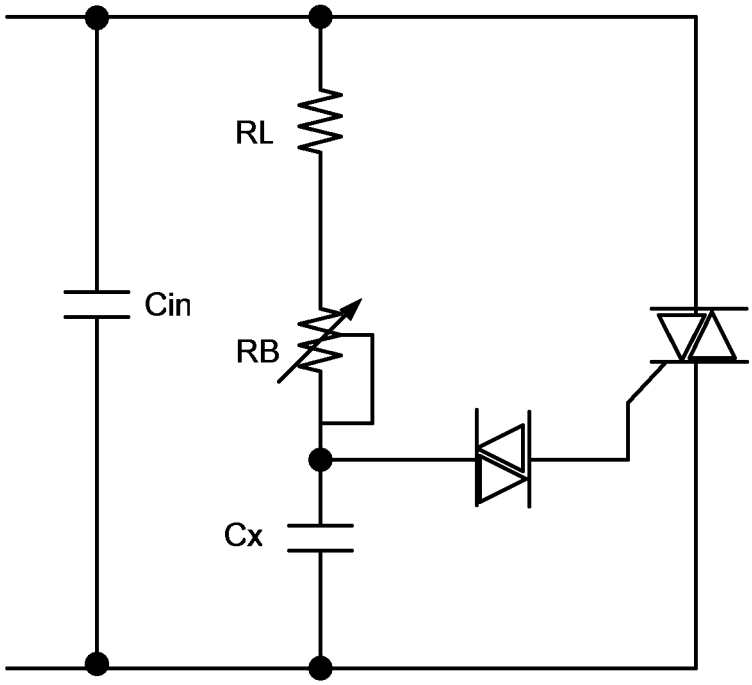
FIG. 1 is a schematic block diagram of an example silicon-controlled dimmer.

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

A silicon-controlled rectifier (SCR) dimmer is commonly used for dimming control. By utilizing phase control to achieve dimming, the SCR dimmer can be controlled to be turned on during every half cycle of the sine wave, in order to get a conduction angle. The conduction angle can be regulated by adjusting the chopper phase of the SCR dimmer to achieve dimming. The SCR dimmer has previously been used for incandescent lamp to control dimming. With the popularity of light-emitting diode (LED) light, increasingly LED driving circuits utilize SCR dimmers to control dimming of the LED light. Typically, the SCR dimmer may be utilized in conjunction with a linear constant current control scheme. The linear constant current control scheme can control a current flowing through an LED load to be constant by controlling a linear device (e.g., a transistor operating in a linear region/mode) that is substantially in series with at least one portion of the LED load.

There are several different variations of linear constant current control scheme, such as all the LED loads being controlled through a linear device to achieve constant current control, or the LED loads being grouped, whereby a corresponding one linear device is arranged for each group to achieve constant current control. For different linear constant current control schemes, different load driving voltages may be required. Therefore, when a driving circuit with an SCR dimmer is utilized to drive an LED load, a driving voltage when the SCR dimmer is turned on may not be available for the LED load. Furthermore, a leakage current may unavoidable before the SCR dimmer is turned on depending on the types of the SCR dimmer and the parameters of the LED driving circuit. Because the leakage current may vary along with the parameters and types of SCR dimmers, the conduction angle may correspondingly vary. As a result, an error between the ideal conduction angle and a real conduction angle may occur, which can cause flickering of the LED load.

Referring now to FIG. 1, shown is a schematic block diagram of an example SCR dimmer. An AC path can charge capacitor Cx through resistor RL and resistor RB when the silicon-controlled dimmer is not turned on. The condition for the silicon-controlled dimmer is that the voltage across capacitor Cx reaches the conduction threshold, and the conduction point of the silicon-controlled dimmer can be regulated by adjusting resistance RB. Due to current charging capacitor Cx during turning off of the silicon-controlled dimmer, the silicon-controlled dimmer may have a leakage current, and the leakage current can also be formed in capacitor Cin due to the voltage difference across the two terminals of capacitor Cin. As discussed above, the presence of such a leakage current can cause the conduction angle of the silicon-controlled dimmer to be indefinite, thereby causing the LED load to flicker.

Figure 2:
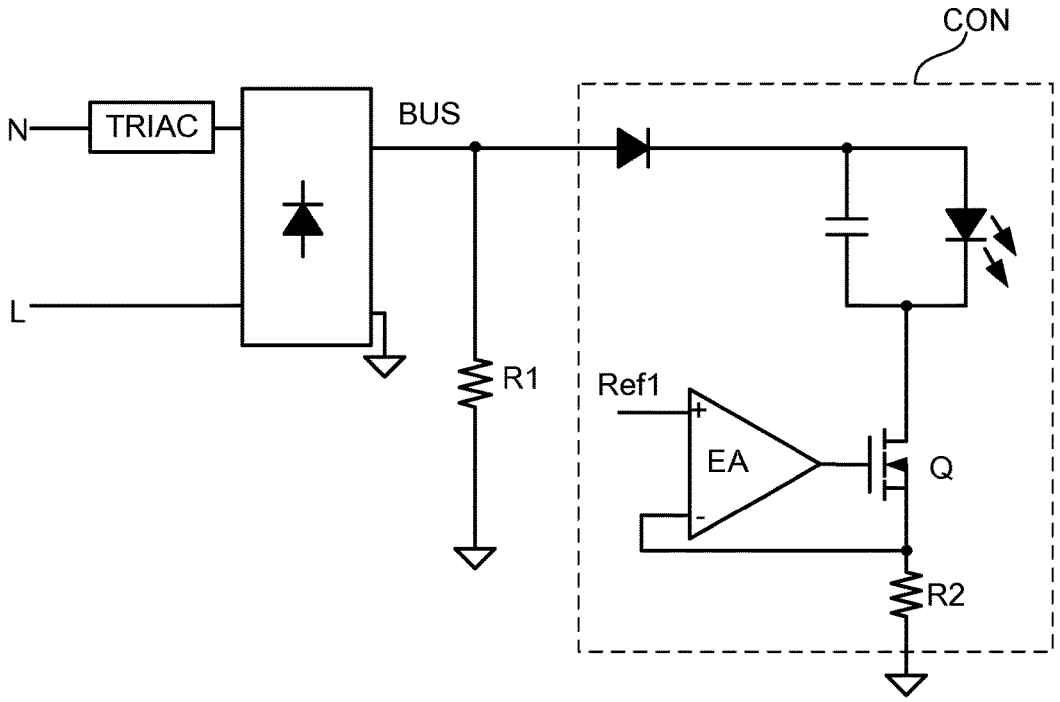
FIG. 2 is a schematic block diagram of an example LED driver.

Referring now to FIG. 2, shown is a schematic block diagram of an example LED driver. The leakage current can be resolved according to this example. This example LED driver can include silicon-controlled dimmer TRIAC, a rectifier circuit, constant current control circuit CON, and bleed resistor R1. SCR dimmer TRIAC can connect between an AC input terminal and the rectifier circuit for chopping an AC input voltage. The rectifier circuit can convert alternating current voltage to direct current voltage. Constant current control circuit CON can integrate an LED load and regulate a load current flowing through the LED load through transistor Q. In addition, load current sampling signal Ref1 can be sampled by resistor R2 coupled in series with transistor Q and fed back to error amplifier EA. Error amplifier EA can achieve constant current control for transistor Q according to load current reference signal Ref1 and load current sampling signal Ref1. Bleed resistor R1 can connect between DC bus voltage BUS and ground for drawing a leakage current of silicon-controlled dimmer TRIAC, in order to prevent DC bus voltage VBUS from varying with the AC input voltage due to the leakage current, and to prevent a voltage difference on silicon-controlled dimmer TRIAC from being reduced. In this way, delay of the turn-on operation of the silicon-controlled dimmer can be avoided and dimming with full brightness can also be achieved.

Figure 3:
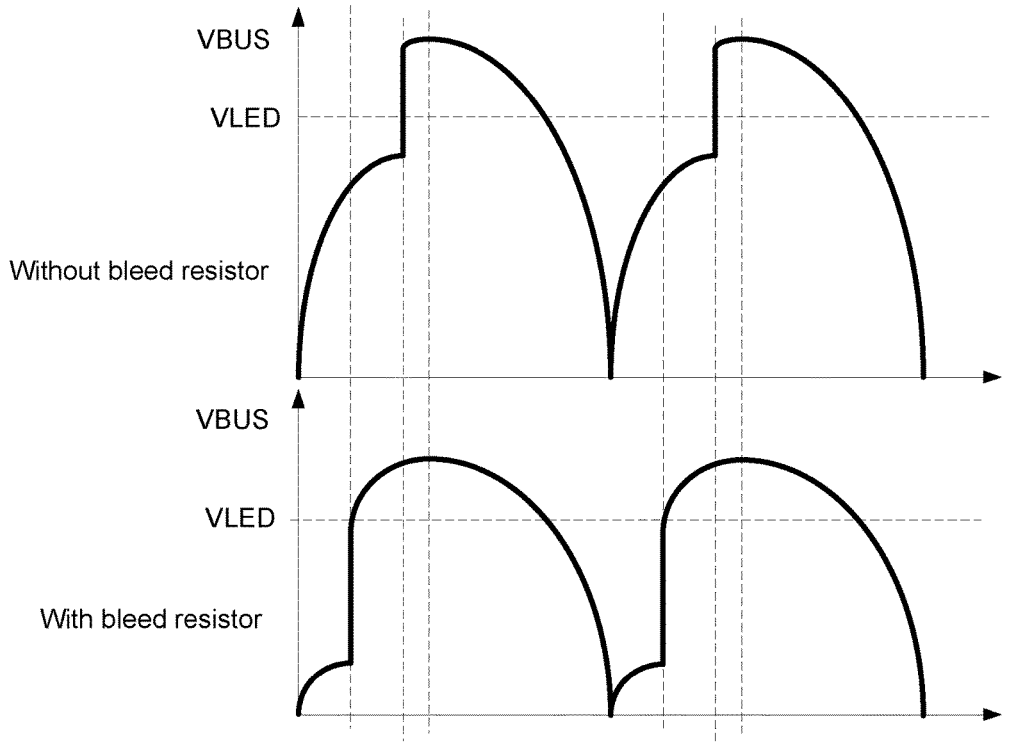
FIG. 3 is a waveform diagram of example operation of the circuit of FIG. 2.

Referring now to FIG. 3, shown is a waveform diagram of example operation of the circuit of FIG. 2. The turn-on time of silicon-controlled dimmer TRIAC may be delayed without bleed resistor R1, and DC bus voltage VBUS can be higher before silicon-controlled dimmer TRIAC is turned on. Also, DC bus voltage VBUS can be greater than a load driving voltage after silicon-controlled dimmer TRIAC is turned on. The conduction time of silicon-controlled dimmer TRIAC can be advanced with bleed resistor R1, in order to reduce losses when the silicon-controlled dimmer is off. However, bleed resistor R1 can introduce additional losses and lead to decreased efficiency in some cases.

Figure 4:
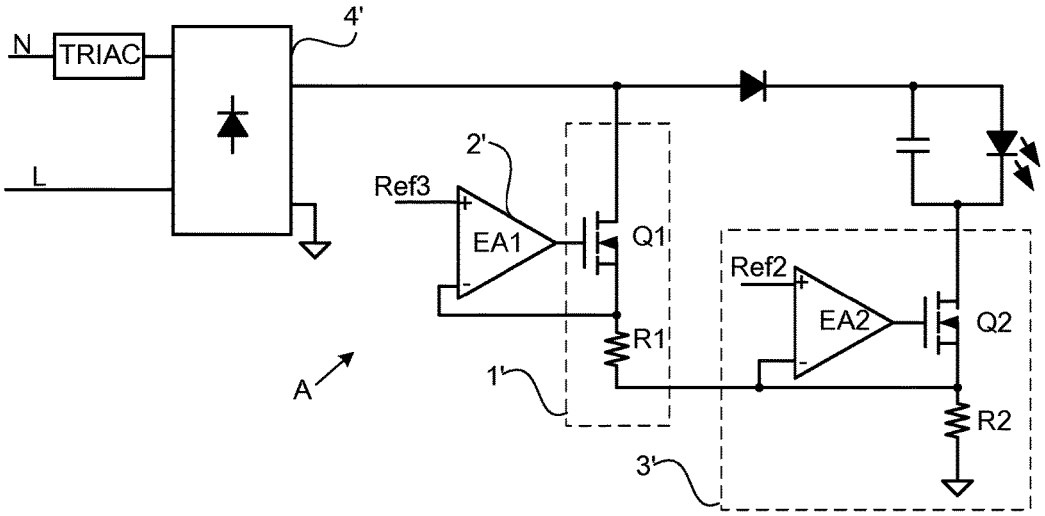
FIG. 4 is a schematic block diagram of another example LED driver.

Referring now to FIG. 4, shown is a schematic block diagram of another example LED driver. In this particular example, LED driver A can include silicon-controlled dimmer TRIAC, bleeder circuit 1', controller 2', constant current control circuit 3', and rectifier circuit 4'. LED driver A may further include a diode coupled to DC bus voltage and a filter capacitor coupled in parallel with an LED load. Silicon-controlled dimmer TRIAC can connect between rectifier circuit 4' and an AC input terminal for chopping an input alternating current voltage. Rectifier circuit 4' can convert alternating current voltage to direct current voltage. Constant current control circuit 3' can coupled in series with the LED load, and a load current flowing through the LED load can be substantially constant and controllable by controlling transistor Q2 to operate in a linear region. Constant current control circuit 3' may include transistor Q2 and error amplifier EA2 for controlling transistor Q2.

Transistor Q2 can connect between the LED load and resistor R2. One terminal of resistor R2 can connect to a source of transistor Q2. The gate of transistor Q2 can connect to an output terminal of error amplifier EA2. One input terminal of error amplifier EA2 (e.g., the non-inverting input) can receive load current reference signal Ref2, and another input terminal of error amplifier EA2 (e.g., the inverting input) can be coupled to the source of transistor Q2. The voltage at the inverting input of error amplifier EA2 can represent the load current flowing through transistor Q2 due to a voltage drop across resistor R2, such that an output signal of error amplifier EA2 can vary along with the load current to form a current closed loop circuit. Transistor Q2 controlled by the output signal of error amplifier EA2 can adjust the load current flowing through transistor Q2 to be consistent with (e.g., the same as) load current reference signal Ref2.

Bleed circuit 1' can substantially be coupled in parallel with the LED load. Bleed circuit 1' may draw a bleed current from a DC bus voltage during the off-state of SCR dimmer TRIAC and when the DC bus voltage is less than predetermined load driving voltage VLED. In this example, bleeder circuit 1' can include transistor Q1 and resistor R1. Resistor R1 can connect between the source of transistor Q1 and one terminal of resistor R2 (e.g., away from ground). Transistor Q1 can connect between the DC bus voltage and resistor R1. Bleeder circuit 1' can be controlled by controller 2' to draw the bleed current. Controller 2' can include error amplifier EA1. Error amplifier EA1 can receive bleed reference signal Ref3 at its non-inverting input terminal, and the voltage at the high voltage terminal of resistor R2 at its inverting input terminal, and may generate a control signal to control the gate of transistor Q1.

For example, bleed reference signal Ref3 can correspond to holding current IL of silicon-controlled dimmer TRIAC. During the period when bus voltage VBUS is less than predetermined load driving voltage VLED, transistor Q2 may be turned off, and transistor Q1 can be turned on to operate in a linear region for bleeding. Bleeder circuit 1' can generate a bleed current greater than or equal to current IL until bus voltage VBUS is greater than load driving voltage VLED. When bus voltage VBUS is increased to be above load drive voltage VLED, transistor Q2 can be controlled to operate in a linear region to regulate load current ILED. Since the voltage at the inverting input terminal of error amplifier EA1 is larger than bleed current reference signal Ref1, the control signal generated by error amplifier EA1 can be negative to control transistor Q1 to be turned off. When bus voltage VBUS is decreased to be below load driving voltage VLED, transistor Q2 can be turned off and transistor Q1 turned on to enable the circuit to bleed again.

Figure 5:
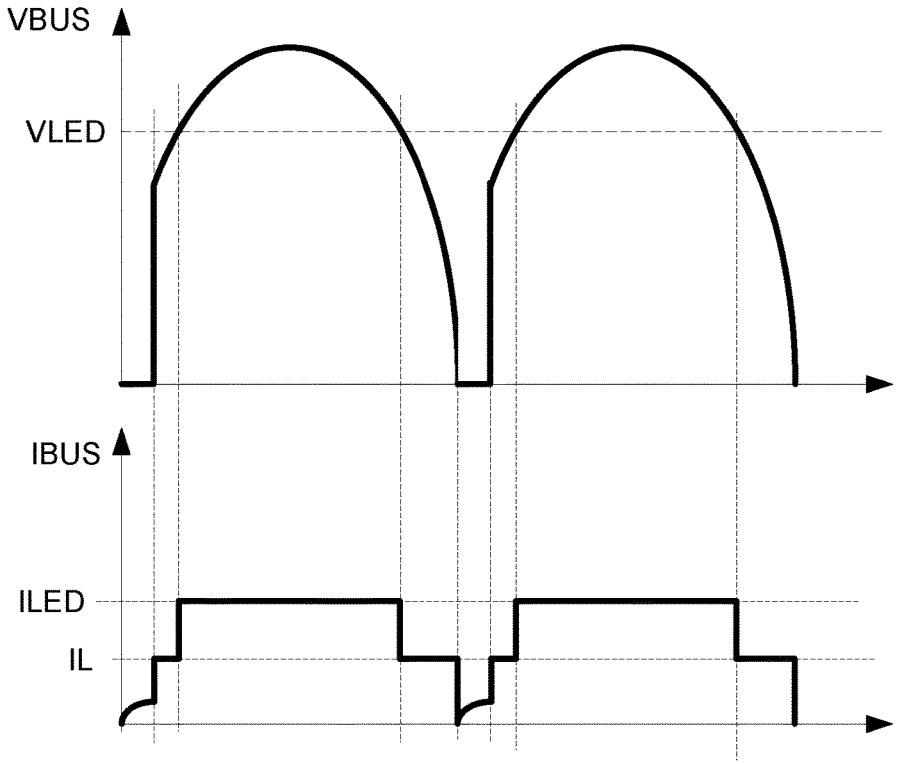
FIG. 5 is a waveform diagram of example operation of the circuit of FIG. 4.

Referring now to FIG. 5, shown is a waveform diagram of example operation of the circuit of FIG. 4. Transistor Q1 can draw a bleed current before silicon-controlled dimmer TRIAC is turned on, and bus voltage VBUS is pulled down to zero, which can improve the consistency of conduction angle of SCR dimmer TRIAC. However, this may also lead to conduction time of silicon-controlled dimmer TRIAC in advance, and decreased efficiency due to the bleed current before silicon-controlled dimmer TRIAC turning on.

In one embodiment, an apparatus can include: (i) a bleeder circuit coupled to a DC bus of an LED driver having a silicon-controlled dimmer; (ii) the bleeder circuit being configured to control a voltage of the DC bus to vary in a predetermined manner by drawing a bleed current through a bleed path when in a first mode, and to cut off the bleed path when in a second mode; and (iii) a controller configured to control the bleeder circuit to be in the first mode before the silicon-controlled dimmer is turned on. Particular embodiments also include associated methods of controlling the bleeder circuit, and LED drivers that include the apparatus.

Figure 6:
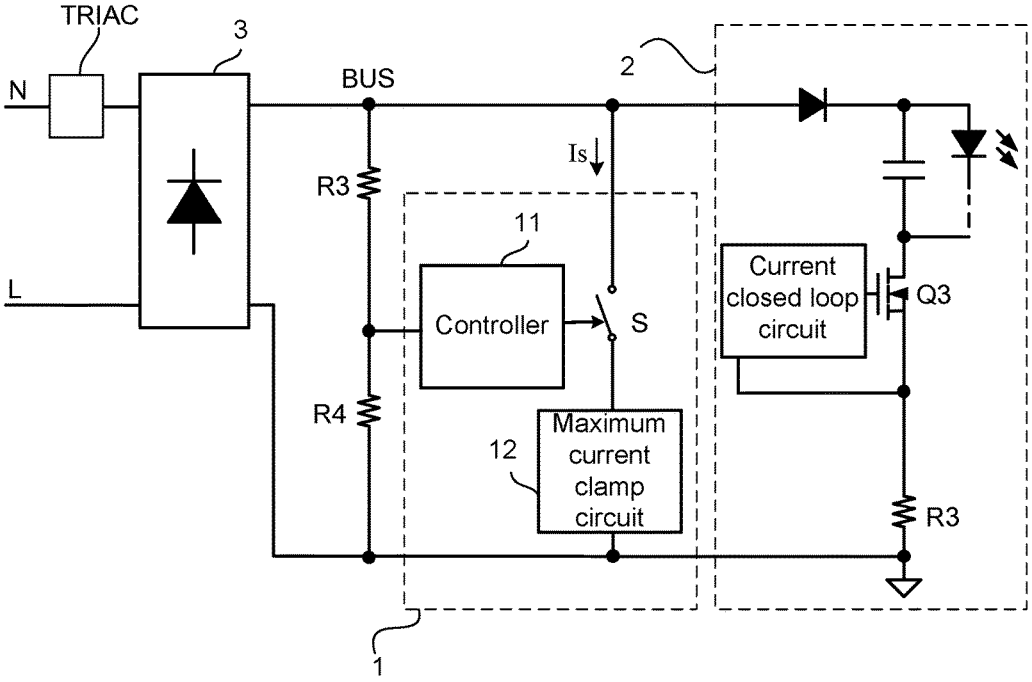
FIG. 6 is a schematic block diagram of a first example LED driver, in accordance with embodiments of the present invention.

Referring now to FIG. 6, shown is a schematic block diagram of a first example LED driver, in accordance with embodiments of the present invention. In this example, the LED driving circuit can include silicon-controlled dimmer TRIAC, apparatus 1 for providing a bleed current, constant current control circuit 2, and rectifier circuit 3. Silicon-controlled dimmer TRIAC can connect between rectifier circuit 3 and an AC input terminal. Rectifier circuit 3 can convert alternating current voltage chopped by silicon-controlled dimmer TRIAC to direct current voltage. Constant current control circuit 2 can include transistor Q3, resistor R3, and a control loop circuit. Constant current control circuit 2 can detect the load current through resistor R3, and control the load current to be substantially constant through current closed loop circuit. Constant current control circuit 2 can integrate LED loads. In particular embodiments, the LED load can also be separated from the linear device and the control circuit of constant current control circuit 2. Furthermore, constant current control circuit 2 can also use multiple linear devices for constant current control, in order to achieve a wide range of load driving voltage.

Bleed current circuit 1 can include a bleeder circuit and controller 11. The bleeder circuit coupled to DC bus voltage VBUS can be controlled to switch between first and second modes of operation. In the first mode, the bleeder circuit can be controlled to stabilized bus voltage VBUS at a non-zero predetermined value to be constant by drawing a bleed current through a bleed path. In the second mode, the bleeder circuit can be controlled to cut off the bleed path. Controller 11 can control the bleeder circuit to operate in the first mode before silicon-controlled dimmer TRIAC is turned on, and to control the bleeder circuit to switch to the second mode after silicon-controlled dimmer TRIAC is turned on.

In certain embodiments, before silicon-controlled dimmer TRIAC is turned on, the bleeder circuit controlled by controller 11 can control DC bus voltage VBUS to vary in a predetermined manner, in order to adjust a voltage of DC bus voltage VBUS at a time instant at which silicon-controlled dimmer TRIAC is turned on, and to cut off the bleed path when silicon-controlled dimmer TRIAC is on. In this example, the bleeder circuit can control DC bus voltage VBUS to vary in a predetermined range such that DC bus voltage VBUS may be approximate to predetermined load driving voltage VLED when silicon-controlled dimmer TRIAC is turned on. Further, DC bus voltage may also be greater than predetermined load driving voltage VLED when silicon-controlled dimmer TRIAC is turned on at the maximum conduction angle of silicon-controlled dimmer TRIAC, such that the LED load can be immediately turned on after silicon-controlled dimmer TRIAC is turned on. In addition, no bleeder circuit may be needed to provide the bleed current in order to prevent silicon-controlled dimmer TRIAC from being turned off after silicon-controlled dimmer TRIAC is turned on, which can reduce system losses and maximize system efficiency.

In this example, the bleeder circuit can include controllable switch S and maximum current clamp circuit 12. Controllable switch S and maximum current clamp circuit 12 can connect in series between DC bus BUS and ground. Maximum current clamp circuit 12 can limit a maximum value of a bleed current flowing through controllable switch S. Since maximum current clamp circuit 12 is arranged in the bleed path, the maximum value of the bleed current may be limited by maximum current clamp circuit 12. When bleed current "Is" is less than clamp current IMAX, maximum current clamp circuit 12 may be in the on-state. When bleed current "Is" is increased to clamp current IMAX, maximum current clamp circuit 12 can clamp the bleed current at clamp current IMAX. When silicon-controlled dimmer TRIAC is turned on, bleed current Is can be increased in order to increase a DC bus current. When the bleed current "Is" is increased to clamp current IMAX, DC bus voltage VBUS may begin to rapidly increase and vary along with the alternating current that is generated by silicon-controlled dimmer TRIAC.

Switch S can be controlled to be turned on or turned off by controller 11. In the first mode, controller 11 can control switch S to be alternately turned on and turned off such that DC bus voltage VBUS may vary in a range between threshold REF1 and threshold REF2. Controller 11 can control switch S to be turned on when DC bus voltage VBUS is increased to threshold REF2, and can control switch S to be turned off when DC bus voltage VBUS is decreased to threshold REF1. For example, threshold REF2 is greater than threshold REF1, and threshold REF1 is not zero.

When controllable switch S is turned on before silicon-controlled dimmer TRIAC is turned on, the bleeder circuit can form the bleed path between DC bus BUS and ground, and the bus current from rectification circuit 3 can be drawn by the bleeder circuit, such that DC bus voltage VBUS can be decreased and may fall back. When controllable switch S is turned off before silicon-controlled dimmer TRIAC is turned on, the bleed path of bleeder circuit can be cut off, such that DC bus voltage VBUS can be increased and vary along with a pulsating DC waveform generated by rectification circuit 3. Therefore, before silicon-controlled dimmer TRIAC is turned on, DC bus voltage VBUS can be controlled to vary in a predetermined range by controlling switch S to be turned on or off. Before silicon-controlled dimmer TRIAC is turned on, DC bus voltage VBUS can be controlled to vary, such that a charge accumulation time period in silicon-controlled dimmer TRIAC can be controlled, in order to control the supply voltage of silicon-controlled dimmer TRIAC when silicon-controlled dimmer TRIAC is turned on.

DC bus voltage VBUS can meet requirements of a predetermined load drive voltage VLED for most types of silicon-controlled dimmers by providing thresholds REF1 and REF2 when silicon-controlled dimmers are turned on at the maximum conduction angle. DC bus current can be greatly increased after silicon-controlled dimmer TRIAC is turned on. The bleed current drawn by the bleeder circuit may be clamped at clamp current IMAX by maximum current clamp circuit 12, and DC bus voltage VBUS may rapidly increase to be greater than threshold REF2. Controller 11 may determine an on-state of silicon-controlled dimmer TRIAC by detecting whether DC bus voltage VBUS is increased to threshold REF3 that is greater than threshold REF2. That is, controller 11 may determine an on-state of silicon-controlled dimmer TRIAC when DC bus voltage VBUS is increased to threshold REF3. Controller 11 can control switch S to be turned off to cut off the bleed path when silicon-controlled dimmer TRIAC is detected to be turned on, and the bus current through DC bus BUS from rectification circuit 3 can flow to the LED load and drive the LED load in order to light.

Figure 7:
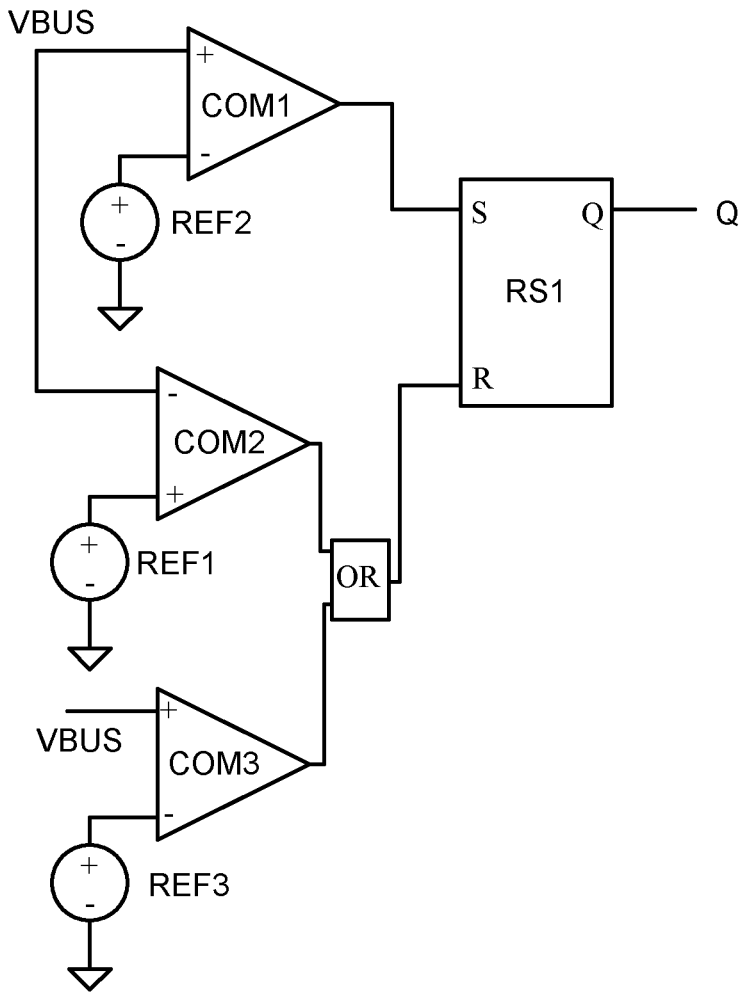
FIG. 7 is a schematic block diagram of an example controller, in accordance with embodiments of the present invention.

Referring now to FIG. 7, shown is a schematic block diagram of an example controller, in accordance with embodiments of the present invention. Controller 11 may include comparators COM1 to COM3, an OR-gate "OR" and RS flip-flop RS1. Comparator COM1 can compare DC bus voltage VBUS against threshold REF2, and may generate a high level when DC bus voltage VBUS is greater than threshold REF2. Comparator COM2 can compare DC bus voltage VBUS against threshold REF1, and may generate a high level when DC bus voltage VBUS is less than threshold REF1. Comparator COM3 can compare DC bus voltage VBUS against threshold REF3, and may generate a high level when DC bus voltage VBUS is greater than threshold REF3. An output terminal of comparator COM1 can connect to a set terminal of RS flip-flop RS1. Output terminals of comparators COM2 and COM3 can respectively connect to two input terminals of OR gate OR. An output terminal of OR-gate "OR" can connect to a reset terminal of RS flip-flop RS1. Also, RS flip-flop RS1 can generate control signal Q (e.g., the output of controller 11 in FIG. 6) for controlling switch S.

As mentioned above, controllable switch S can be controlled to be turned on when DC bus voltage VBUS is greater than threshold REF2, and can be controlled to be turned off when DC bus voltage VBUS is less than threshold REF1, or when DC bus voltage VBUS increases to be greater than threshold REF3. Those skilled in the art will recognize that the connection relationships and configuration of the circuitry can be modified to achieve the same or similar functionality by adopting other logic and/or circuit structures in certain embodiments. For example, a high level is a valid level in this example, and those skilled in the art can easily modify and adjust the circuit according to the definition of the valid level. Furthermore, those skilled in the art may determine the relationship between DC bus voltage and the thresholds by comparing a sampling voltage of DC bus voltage VBUS with reference values corresponding to thresholds REF1 to REF3.

Figure 8:
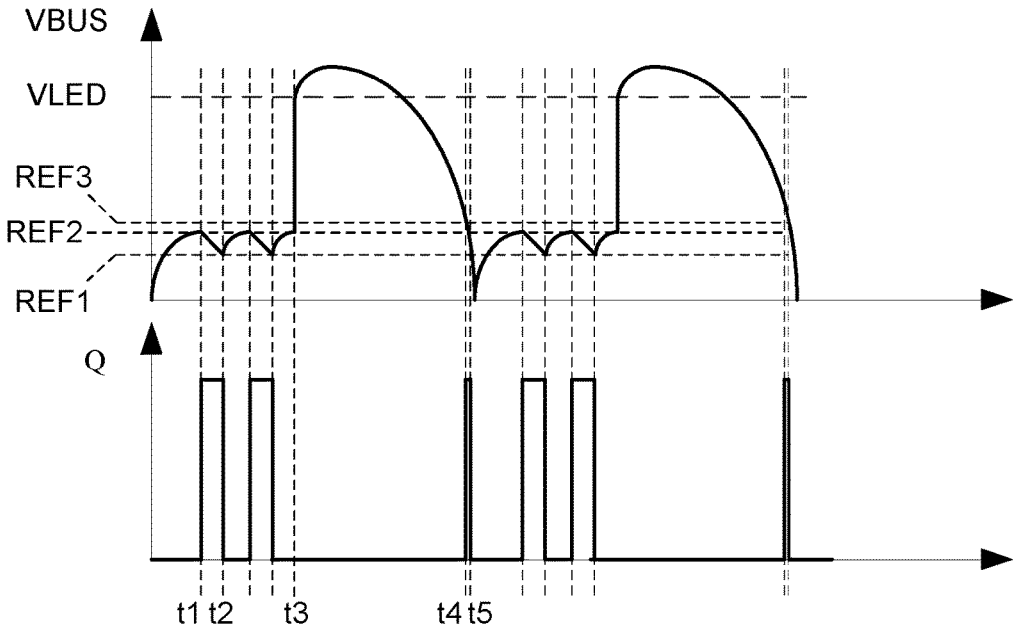
FIG. 8 is a waveform diagram of example operation of the first example LED driver and controller, in accordance with embodiments of the present invention.

Referring now to FIG. 8, shown is a waveform diagram of example operation of the first example LED driver and controller, in accordance with embodiments of the present invention. At the start of a cycle, DC bus voltage VBUS may gradually increase from zero, varying along with an output voltage of rectification circuit 3, and control signal Q is low, such that switch S is turned off. At time t1, DC bus voltage VBUS can increase to be greater than threshold REF2, control signal Q is high, and controllable switch S is turned on, such that the bleeder circuit may begin to draw the bleed current, and DC bus voltage VBUS may fall back. At time t2, DC bus voltage VBUS can decrease to be less than threshold REF1, control signal Q is low, and controllable switch S may be turned off, such that the bleeder circuit may stop drawing the bleed current, and DC bus voltage VBUS can increase again.

As mentioned above, DC bus voltage VBUS may vary in a range between thresholds REF1 and REF2 until time t3. At time t3, while silicon-controlled dimmer TRIAC is turned on, the bleed current of the bleeder circuit may be clamped, and DC bus voltage VBUS may rapidly increase. When DC bus voltage VBUS increases to be greater than threshold REF3, control signal Q can switch to low and remain at the low level, and controllable switch S may be turned off, such that the bleeder circuit can switch to the second mode to cut off the bleed path, and to light the LED load.

At time t4, when DC bus voltage VBUS falls back to threshold REF3, varying along with the output voltage of rectification circuit 3, the output voltage of comparator COM3 can switch to the low level from the high level, and the reset terminal of RS flip-flop RS1 can switch to a low level as well. Since DC bus voltage VBUS is still greater than threshold REF2, the set terminal of RS flip-flop RS1 may remain at a high level. Control signal Q can switch to high in accordance with the characteristics of RS flip-flop RS1, and controllable switch S may be turned on to draw the bleed current for a relatively short time period. At time t5, DC bus voltage VBUS can decrease to be less than threshold REF1, and comparator COM2 can generate a high level, such that control signal Q can switch to low, and controllable switch S may be turned off, being ready for a next cycle.

In this particular example, a controllable switch is provided in the bleeder circuit, and the controllable switch can be controlled to be alternately turned on and turned off, such that DC bus voltage is controlled to vary in a range between two thresholds before the silicon-controlled dimmer is turned on. Also, the DC bus voltage may be controlled to be approximate to the predetermined load drive voltage when the silicon-controlled dimmer is turned on at the maximum conduction angle, resulting in reduced system losses and improved system efficiency.

Figure 9:
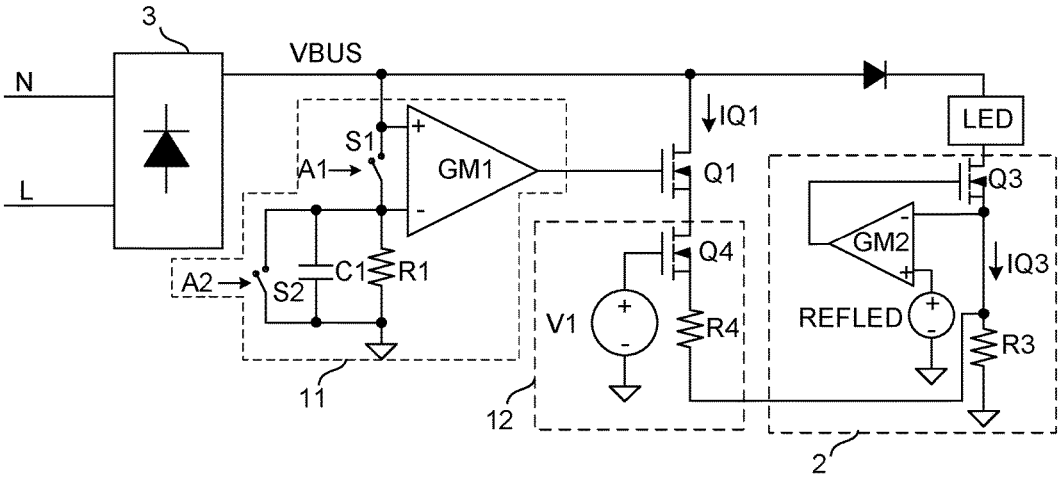
FIG. 9 is a schematic block diagram of a second example LED driver, in accordance with embodiments of the present invention.

Referring now to FIG. 9, shown is a schematic block diagram of a second example LED driver, in accordance with embodiments of the present invention. The LED driver can include silicon-controlled dimmer TRIAC, an apparatus for providing a bleed current, constant current control circuit 2, and rectifier circuit 3. Silicon-controlled dimmer TRIAC can be coupled between rectifier circuit 3, and an alternating current input terminal (see, e.g., FIG. 6). Rectifier circuit 3 can convert alternating current voltage chopped by silicon-controlled dimmer TRIAC to direct current voltage. In FIG. 9, constant current control circuit 2 can include transistor Q3, resistor R3, and a control loop circuit. The control loop circuit can include transconductance amplifier GM2. Constant current control circuit 2 can sample the load current through resistor R3, and control the load current flowing through the LED load to be consistent with (e.g., the same as) reference signal REFLED by the control loop circuit. In particular embodiments, constant current control circuit 2 can also utilize multiple linear devices for constant current control, in order to achieve a wide range of load driving voltage. It should be understood that transconductance amplifier GM2 in the control loop circuit may alternatively be replaced with an error amplifier for generating an error voltage.

The apparatus for providing a bleed current can include a bleeder circuit and controller 11. The bleeder circuit can connected to DC bus BUS, and may be controlled to switch between first and second modes. In the first mode, the bleeder circuit may be controlled to draw a bleed current through a bleed path to control DC bus voltage VBUS not to exceed a predetermined value. In the second mode, the bleeder circuit can be controlled to cut off the bleed path. The bleeder circuit can include transistor Q1 and maximum current clamp circuit 12. In this example, transistor Q1 can be controlled to operate in a linear region, and may regulate DC bus voltage VBUS in accordance with a current at a control terminal (e.g., the gate). Those skilled in the art will recognize that other devices/circuitry utilized as a controlled voltage source can replace transistor Q1 for drawing a bleed current in order to adjust DC bus voltage in particular embodiments. For example, an insulated gate bipolar transistor (IGBT) or a more complicated circuit structure that includes multiple metal oxide semiconductor (MOS) transistors can be utilized in some cases.

In this example, transistor Q1 and maximum current clamp circuit 12 in the bleeder circuit can connect in series between DC bus BUS and resistor R3. Maximum current clamp circuit 12 can include transistor Q4, voltage source V1, and resistor R4. Transistor Q4 and resistor R4 can connect in series in the bleed path for clamping the bleed current. Voltage source V1 can connect between a control terminal of transistor Q4 and ground. with no current flowing through resistor R3, bleed current IQ1 flowing through the bleed path can be clamped when the bleed current flowing through transistor Q4 is increased to reach clamp current IMAX. Clamp current IMAX can be calculated by formula (1) below.

$$IMAX = \frac{(V1 - Q4_th)}{R4 + R3} \quad (1)$$

Here, Q4_*th* is a maximum gate-drain voltage drop of transistor Q4. With current IQ3 flowing through resistor R3 (e.g., silicon-controlled dimmer TRIAC is turned on), clamp current IMAX of maximum current clamp circuit 12 can be calculated by formula (2) below.

$$IMAX = \frac{V1 - Q4_th - IQ3 \times R3}{R4 + R3} \quad (2)$$

When silicon-controlled dimmer TRIAC is turned on, current IQ3 flowing through transistor Q3 can be increased, and a voltage drop across resistor R3 can be increased, such that clamp current IMAX can decrease to near zero, or maximum current clamp circuit 12 can be shut off. In other cases, maximum current clamp circuit 12 can also be implemented with other structures. As connection relationships mentioned above, after silicon-controlled dimmer TRIAC is turned on, the LED load can be driven to light up, and maximum current clamp circuit 12 can clamp the bleed current at a relatively low current value or may be shut off, in order to automatically cut off the bleed path.

Controller 11 can control the bleeder circuit to be in the first mode before detecting that silicon-controlled dimmer TRIAC is turned on. The bleeder circuit can be controlled by controller 11 to draw the bleed current through the bleed path before silicon-controlled dimmer TRIAC is turned on, maintaining DC bus voltage VBUS to be not greater than a threshold REF4. The bleed path can be cut off after silicon-controlled dimmer TRIAC is turned on. In the first mode, the bleed current flowing through transistor Q1 can be controlled by controller 11, in order to maintain DC bus voltage VBUS to vary in a predetermined manner. For example, controller 11 can control DC bus voltage VBUS to gradually decrease after DC bus voltage VBUS is increased to threshold REF4 until silicon-controlled dimmer TRIAC is turned on. Therefore, possible side effects of conducting angle of the silicon-controlled dimmer due to different leakage currents that may be caused by different types of silicon-controlled dimmer and different circuit parameters, can be substantially avoided.

Controller 11 can include transconductance amplifier GM1, control switch S1, control switch S2, charging capacitor C1, and discharging resistor R1. A non-inverting input terminal of transconductance amplifier GM1 can connect to DC bus BUS. Control switch S1 can connect between the non-inverting input terminal and an inverting input terminal of transconductance amplifier GM1. Control switch S2, charging capacitor C1, and discharging resistor R1 can connect in parallel between the inverting input terminal of transconductance amplifier GM1 and ground.

Control switches S1 and S2 can remain in a normally-off state and may be turned on in response to prospective control signals A1 and A2. When control switch S1 is turned on, control switch S2 may be turned off, and charging capacitor C1 can rapidly charge, such that voltage VC across charging capacitor C1 may be equal to DC bus voltage VBUS. When control switches S1 and S2 are turned off, charging capacitor C1 can be slowly discharged through resistor R1, such that voltage VC across charging capacitor C1 can gradually decrease. Transconductance amplifier GM1 can control the current at output terminal in accordance with a difference voltage between DC bus voltage VBUS and voltage VC across charging capacitor C1, such that DC bus voltage VBUS can be controlled to vary along with voltage VC across charging capacitor C1.

Figure 10:
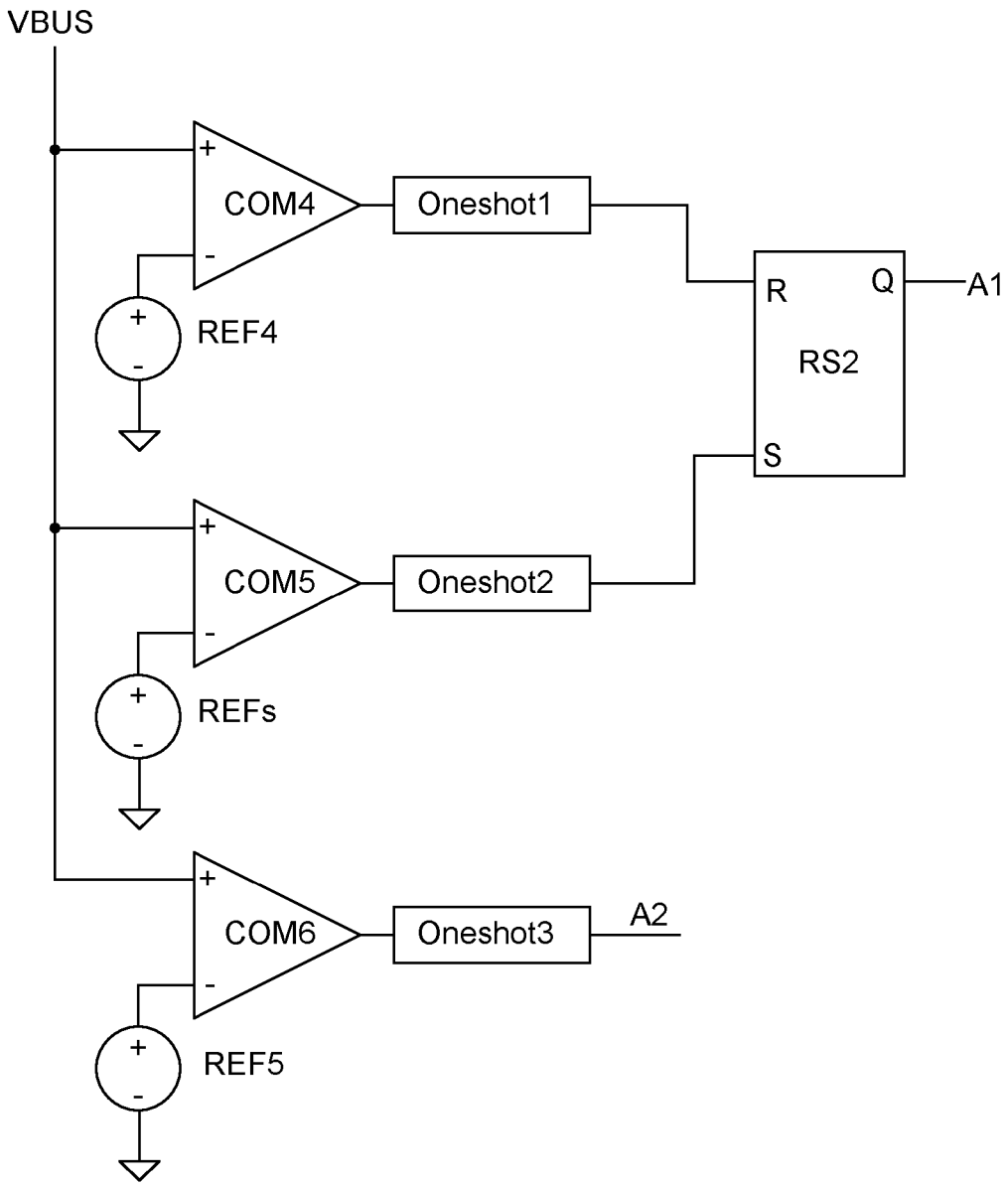
FIG. 10 is a schematic block diagram of a switch control circuit in a controller of the second example, in accordance with embodiments of the present invention.
Figure 11:
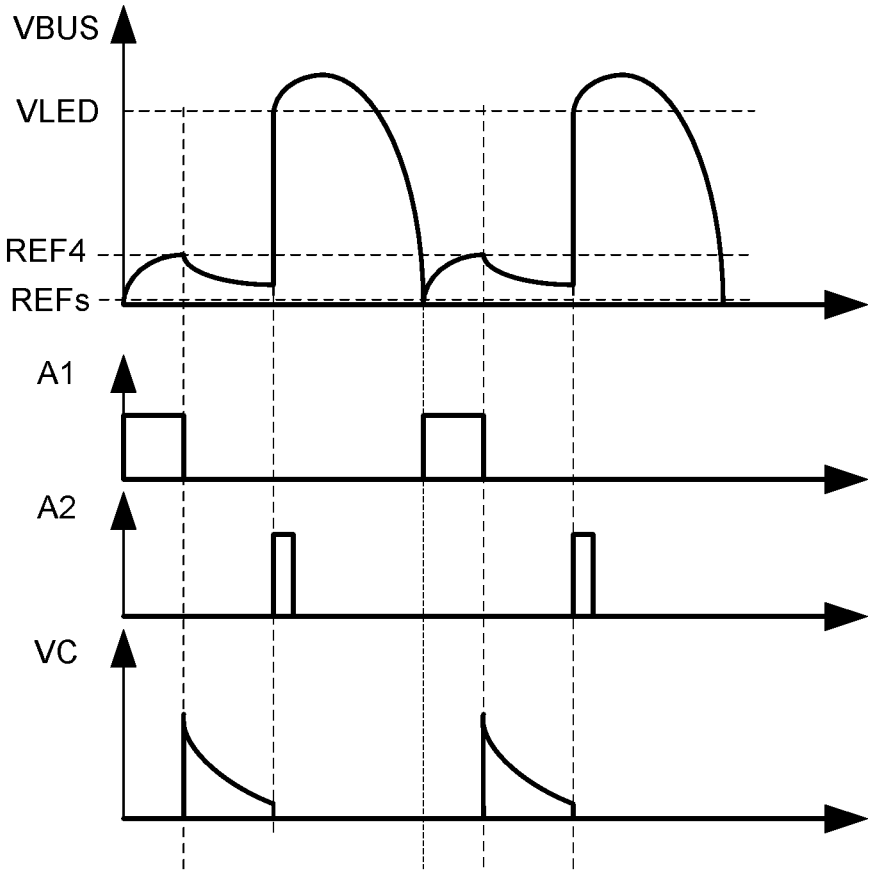
FIG. 11 is a waveform diagram of example operation with a first parameter of the second example LED driver, in accordance with embodiments of the present invention.

Referring now to FIG. 10, shown is a schematic block diagram of a switch control circuit in a controller of the second example, in accordance with embodiments of the present invention. Referring also to FIG. 11, shown is a waveform diagram of example operation with a first parameter of the second example LED driver, in accordance with embodiments of the present invention. The switch control circuit can generate control signals A1 and A2 to respectively control switches S1 and S2 in FIG. 9. In FIG. 10, the switch control circuit can include comparators COM4, COM5, and COM6, single pulse trigger circuits Onehsot1, Oneshot2, and Oneshot3, and RS flip-flop RS2. Comparator COM4 can compare DC bus voltage VBUS against threshold REF4, and may generate a high level when DC bus voltage VBUS is increased to be greater than threshold REF4.

Single pulse trigger circuit Oneshot1 can connect to an output terminal of comparator COM4, and may generate a pulse signal having a predetermined time duration in response to a rising edge of an output signal of comparator COM4. Comparator COM5 can compare DC bus voltage VBUS against start threshold REFs, and may generate a high level when DC bus voltage VBUS is increased to be greater than start threshold REFs. Single pulse trigger circuit Oneshot2 can connect to an output terminal of comparator COM5, and may generate a pulse signal having a predetermined time duration in response to a rising edge of an output signal of comparator COM5. RS flip-flop RS2 may have a set terminal connected to an output terminal of one-shot circuit Oneshot2, and a reset terminal connected to an output terminal of single pulse trigger circuit Oneshot1. RS flip-flop RS2 may generate control signal A1.

When DC bus voltage VBUS is increased to be greater than start threshold REFs, RS flip-flop RS2 can be set and control signal A1 may switch to a high level. When DC bus voltage VBUS is increased to threshold REF4, RS flip-flop RS2 may be reset, and control signal A1 may switch to a low level. Comparator COM6 can compare DC bus voltage VBUS against threshold REF5, and may generate a high level when DC bus voltage VBUS is increased to be greater than threshold REF5. Single pulse trigger circuit one-shot circuit Oneshot3 can connect to an output terminal of comparator COM6, and may generate control signal A2 having a predetermined time duration in response to a rising edge of an output signal of comparator COM6. For example, threshold REF5 is greater than threshold REF4.

Control switch S1 can be turned on for a predetermined time duration during DC bus voltage increasing to be greater than threshold REF4, in order to charge capacitor C1, such that voltage VC across charging capacitor C1 can be equal to DC bus voltage VBUS (VBUS=REF4). Then, control switch S1 can be turned off while control switch S2 may remain in the off state, such that charging capacitor C1 can slowly discharge through resistor R1, and voltage VC across charging capacitor C1 can slowly decrease. Controller 11 can control DC bus voltage VBUS to slowly decrease with voltage VC across charging capacitor C1 until silicon-controlled dimmer TRIAC is turned on.

After silicon-controlled dimmer TRIAC is turned on, DC bus voltage VBUS can rapidly increase to be greater than threshold REF5, such that control switch S2 can be turned on for a predetermined time period, charging capacitor C1 can be discharged through control switch S2, and voltage VC across charging capacitor C1 may reduce toward zero. As a result, the LED load can be lit and a current can flow through transistor Q3, such that the clamp current of maximum current clamp circuit 12 can decrease to be near zero, or maximum current clamp circuit 12 can be shut off, in order to shut off the bleed path until the next cycle begins.

Figure 12:
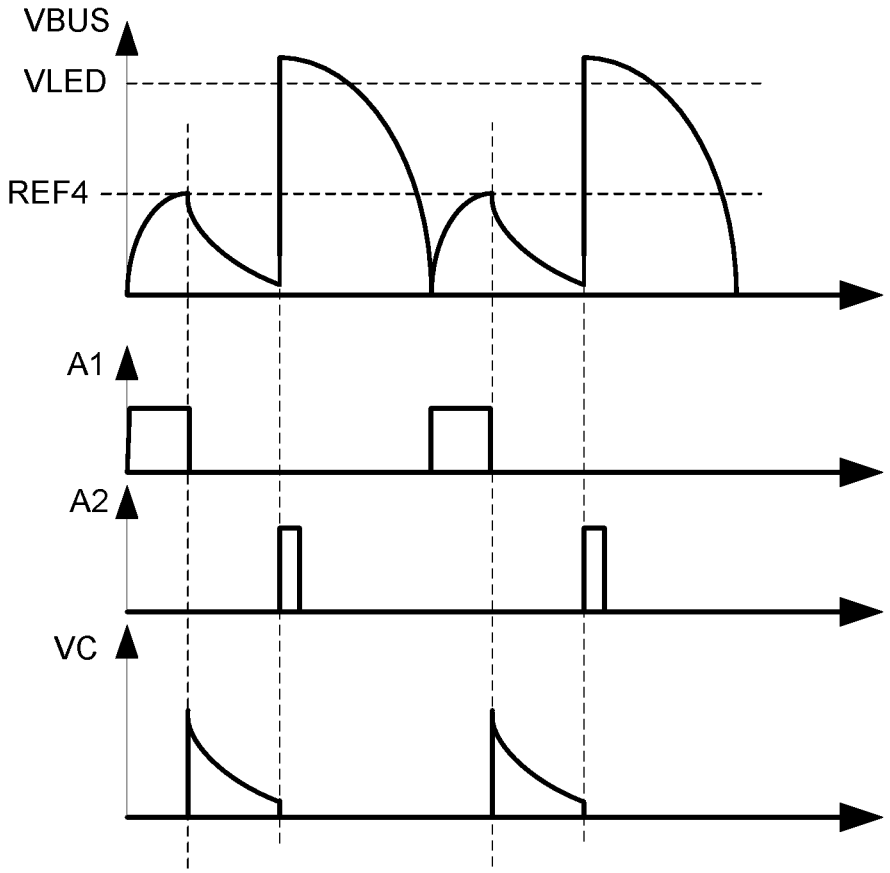
FIG. 12 is a waveform diagram showing example operation with a second parameter of the second example LED driver, in accordance with embodiments of the present invention.

Referring now to FIG. 12, shown is a waveform diagram showing example operation with a second parameter of the second example LED driver, in accordance with embodiments of the present invention. The maximum conduction angle of silicon-controlled dimmer TRIAC may be adjusted by selecting the value of threshold REF4. FIGS. 11 and 12 are waveform diagrams showing operation of the LED driver when different circuit parameters are selected. As shown in FIG. 11, when smaller threshold REF4 is selected, less power flowing from silicon-controlled dimmer TRIAC to rectification circuit 3 can flow to DC bus BUS, and capacitor Cx (as shown in FIG. 1) in silicon-controlled dimmer TRIAC may be rapidly charged to reach the conduction threshold, such that the turn-on operation of silicon-controlled dimmer TRIAC may be advanced.

As shown in FIG. 12, when greater threshold REF4 is selected, more power flowing from silicon-controlled dimmer TRIAC to rectification circuit 3 can flow to DC bus BUS, and capacitor Cx in silicon-controlled dimmer TRIAC may be charged for a longer time period to reach the conduction threshold, such that the turn-on operation of the SCR dimmer TRIAC is delayed. By adjusting the conduction angle of silicon-controlled dimmer TRIAC, DC bus voltage VBUS may be adjusted when silicon-controlled dimmer TRIAC is turned on, such that DC bus voltage VBUS can meet the predetermined load driving voltage, and the system efficiency can be improved.

Figure 13:
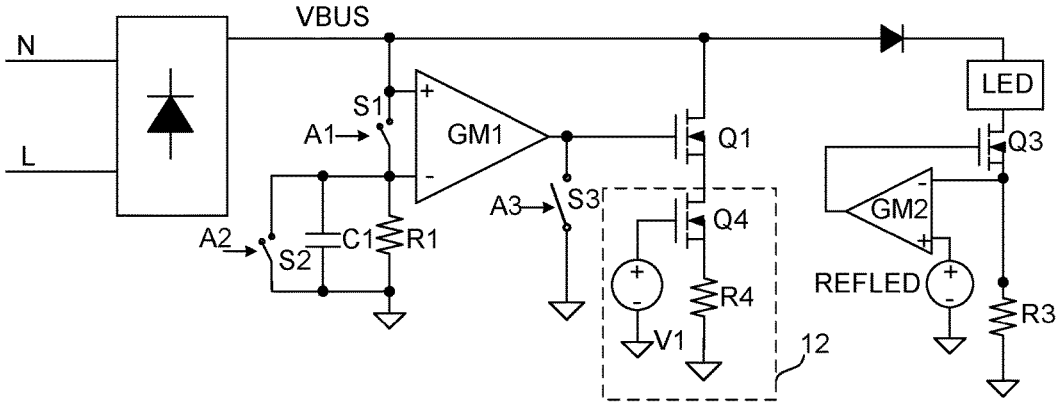
FIG. 13 is a schematic block diagram of a third example LED driver, in accordance with embodiments of the present invention.

Referring now to FIG. 13, shown is a schematic block diagram of a third example LED driver, in accordance with embodiments of the present invention. In this example, the structure of LED driver can be consistent with that in the second example, except that transistor Q1 and maximum current clamp circuit 12 in the bleeder circuit are connected in series between DC bus BUS and ground, such that clamp current IMAX of maximum current clamp circuit 12 may be not be pulled down after silicon-controlled dimmer TRIAC is turned on. The LED driver in this example can actively turn off transistor Q1 in the second mode (e.g., when silicon-controlled dimmer TRIAC is detected to be turned on) by controller 11.

For example, controller 11 can turn off transistor Q1 by control switch S3 connected between transconductance amplifier GM1 and ground. Control switch S3 can be controlled by control signal A3. Control signal A3 may go high when DC bus voltage VBUS is increased to threshold REF5, in order to determine that silicon-controlled dimmer TRIAC is turned on, and the bleeder circuit may be controlled to change to the second mode. The gate voltage of transistor Q1 can be pulled down to zero by control switch S3 controlled by control signal A3, and transistor Q1 can be turned off to cut off the bleed path. Before silicon-controlled dimmer TRIAC is turned on, since control switch S3 may remain off, the operation of the bleeder circuit in this example can be the same as discussed above. Optionally, control switch S3 can be controlled to be turned off in other ways. For example, when DC bus voltage VBUS is detected to be greater than a predetermined threshold during a predetermined time period, silicon-controlled dimmer TRIAC can be determined to be turned on, and control switch S3 can be controlled to be turned on.

Figure 14:
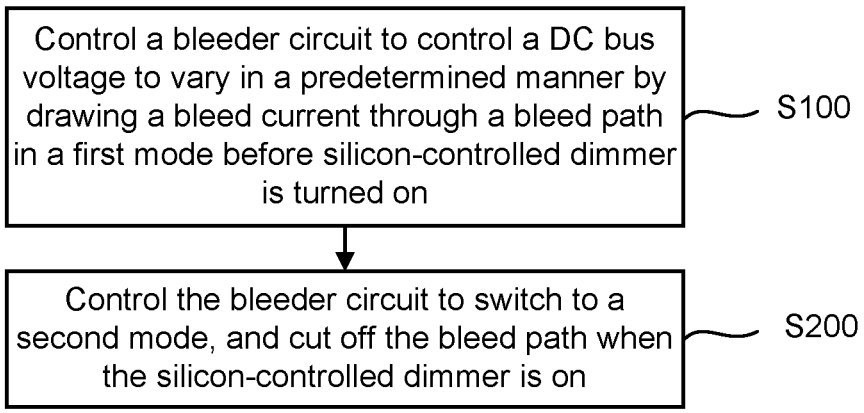
FIG. 14 is a flow diagram of an example method of controlling a bleeder circuit, in accordance with embodiments of the present invention.

Referring now to FIG. 14, shown is a flow diagram of an example method of controlling a bleeder circuit, in accordance with embodiments of the present invention. In this example, at S100, the bleeder circuit can control a DC bus voltage to vary in a predetermined manner by drawing a bleed current through a bleed path in a first mode before silicon-controlled dimmer is turned on. For example, the DC bus voltage can be controlled to vary in a predetermined range in the first mode, such that the DC bus voltage can be slightly larger than a predetermined load driving voltage when the silicon-controlled dimmer is turned on. Alternatively, the DC bus voltage can be controlled to gradually decrease when the DC bus voltage is increased to a fourth threshold in the first mode, such that the DC bus voltage can be approximate to a predetermined load driving voltage when the silicon-controlled dimmer is turned on. At S200, the bleeder circuit can be controlled to switch to a second mode, and to cut off the bleed path when the silicon-controlled dimmer is turned on.

It should be understood that although the above describes that the controller is constructed using analog circuitry, those skilled in the art can understood that the controller can additionally or alternatively be constructed by using a digital circuitry and a digital-to-analog/digital conversion device (s). The digital circuitry may be can be implemented in one or more dedicated circuit blocks (ASICs), digital signal processors (DSPs), digital signal processing devices (DSPDs), programmable logic devices (PLDs), field programmable gate arrays (FPGAs), processors, controllers, microcontrollers, microprocessors, or other electronic units or combinations thereof configured to perform the circuit functions as described herein. Particular embodiments may also be implemented with hardware in combination with firmware or software implementations (e.g., procedures, functions, etc.) that can perform various functions as described herein, whereby such software/code can be stored in memory and executed by a processor, whereby the memory may be implemented within the processor or outside the processor.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. An apparatus, comprising:

a) a bleeder circuit coupled between a DC bus of a light-emitting diode (LED) driver having a silicon-controlled dimmer, and an LED driving sub-circuit having an LED load and a first transistor coupled in series;

b) a controller configured to control, when said silicon-controlled dimmer is off, said bleeder circuit to control a voltage of said DC bus that is generated across two output terminals of a rectifier bridge, wherein said rectifier bridge is coupled to said silicon-controlled dimmer, and said DC bus voltage is configured to provide a load driving voltage to said LED load; and c) said bleeder circuit being configured to control said DC bus voltage to be approximate to a predetermined load driving voltage that is said load driving voltage when said silicon-controlled dimmer conducts at a maximum conduction angle.

2. The apparatus of claim 1, wherein said controller is configured to control said bleeder circuit to change to said from a first mode to a second mode when said silicon-controlled dimmer is turned on, and wherein said DC bus voltage is not regulated when in said second mode.

3. The apparatus of claim 1, wherein said bleeder circuit comprises a controllable switch configured to be alternately turned on and turned off when said silicon-controlled dimmer is off such that said DC bus voltage varies in a range between first and second thresholds, wherein said first threshold is less than said second threshold.

4. The apparatus of claim 3, wherein said bleeder circuit further comprises a maximum current clamp circuit coupled in series with said controllable switch, and being configured to limit a maximum value of said bleed current flowing through said controllable switch.

5. The apparatus of claim 3, wherein said controller is configured to control said controllable switch to be turned on when said DC bus voltage is increased to said second threshold, and to be turned off when said DC bus voltage is decreased to said first threshold.

6. The apparatus of claim 3, wherein said controller is configured to control said controllable switch to be turned off when said DC bus voltage is increased to a third threshold, wherein said third threshold is greater than said second threshold.

7. The apparatus of claim 3, wherein said controller is configured to determine an on state of said silicon-controlled dimmer when said DC bus voltage is greater than a third threshold, wherein said third threshold is greater than said second threshold.

8. The apparatus of claim 1, wherein said bleeder circuit is configured to control said DC bus voltage to gradually decrease when said DC bus voltage is increased to a fourth threshold when said silicon-controlled dimmer is off.

9. The apparatus of claim 8, wherein said bleeder comprises a second transistor controlled to operate in a linear region by said controller when said silicon-controlled dimmer is off.

10. The apparatus of claim 8, wherein said controller is configured to determine an on state of said silicon-controlled dimmer when said DC bus voltage is greater than a fifth threshold.

11. The apparatus of claim 9, wherein said bleeder further comprises a maximum current clamp circuit coupled in series with said second transistor, wherein said maximum current clamp circuit is configured to limit a maximum value of said bleed current flowing through said second transistor.

12. The apparatus of claim 11, wherein:

a) said second transistor and said maximum current clamp circuit are coupled in series between said DC bus and ground; and b) said controller is configured to control said second transistor to be turned off when said silicon-controlled dimmer is on.

13. The apparatus of claim 9, wherein said controller comprises:

a) a transconductance amplifier having an output terminal coupled to a control terminal of said second transistor, and a non-inverting input terminal coupled to said DC bus;

b) a first control switch coupled between said non-inverting input terminal and an inverting input terminal of said transconductance amplifier;

c) a second control switch, a charging capacitor, and a discharging resistor coupled in parallel between said inverting input terminal of said transconductance amplifier and ground; and d) a third control switch coupled between said output terminal of said transconductance amplifier and ground, wherein said first control switch is turned on during said DC bus voltage is increased from a start threshold to said fourth threshold, said second control switch is turned on for a predetermined time duration when said DC bus voltage is increased to said fifth threshold, and said third control switch is turned on when an on state of said silicon-controlled dimmer is determined by said controller.

14. The apparatus of claim 11, wherein:

a) said LED driver circuit comprises a constant control circuit coupled between said LED load and ground;

b) said constant control circuit is configured to provide a resistor coupled to ground; and c) said second transistor and said maximum current clamp circuit are coupled between said DC bus and said resistor such that said maximum current clamp circuit is shut off or a maximum clamp current is less than a predetermined threshold when a load current flows through said LED load.

15. The apparatus of claim 9, wherein said controller comprises:

a) a transconductance amplifier having an output terminal coupled to a control terminal of said second transistor, and a non-inverting input terminal coupled to said DC bus;

b) a first control switch coupled between said non-inverting input terminal and an inverting input terminal of said transconductance amplifier; and c) a second control switch, a charging capacitor, and a discharging resistor coupled in parallel between said inverting input terminal of said transconductance amplifier and ground, wherein said first control switch is turned on during said DC bus voltage is increased from a start threshold to said fourth threshold, and said second control switch is turned on for a predetermined time period when said DC bus voltage is increased to said fifth threshold.

16. A method of controlling a bleeder circuit coupled between a DC bus of a light-emitting diode (LED) driver having a silicon-controlled dimmer, and an LED driving sub-circuit having an LED load and a transistor coupled in series, the method comprising:

a) controlling, by said bleeder circuit when said silicon-controlled dimmer is off, a voltage of said DC bus generated across two output terminals of a rectifier bridge, wherein said rectifier bridge is coupled to said silicon-controlled dimmer, and said DC bus voltage is configured to provide a load driving voltage to said LED load; and b) controlling, by said bleeder circuit, said DC bus voltage to be approximate to a predetermined load driving voltage that is said load driving voltage when said silicon-controlled dimmer conducts at a maximum conduction angle.

17. The method of claim 16, further comprising controlling said DC bus voltage to vary in a predetermined range between a first threshold and a second threshold that is greater than said first threshold when said silicon-controlled dimmer is off.

18. The method of claim 16, further comprising decreasing said DC bus voltage, in response to said DC bus voltage having increased, to a third threshold when said silicon-controlled dimmer is off.

19. The method of claim 16, further comprising controlling said bleeder circuit to change from a first mode to a second mode after said silicon-controlled dimmer is turned on, wherein said bleeder circuit is disabled when in said second mode.

* * * * *